US008381484B2

(12) United States Patent
Bonds

(10) Patent No.: US 8,381,484 B2
(45) Date of Patent: Feb. 26, 2013

(54) INSULATED MODULAR BUILDING FRAME

(75) Inventor: Delton J. Bonds, Kent, WA (US)

(73) Assignee: ISSI Holding Company, LLC, Kent, WA (US)

( * ) Notice: Subject to any disclaimer, the term of this patent is extended or adjusted under 35 U.S.C. 154(b) by 868 days.

(21) Appl. No.: 12/224,631

(22) PCT Filed: Feb. 15, 2008

(86) PCT No.: PCT/US2008/002023

§ 371 (c)(1),
(2), (4) Date: Sep. 2, 2008

(87) PCT Pub. No.: WO2008/103285

PCT Pub. Date: Aug. 28, 2008

(65) Prior Publication Data

US 2009/0044480 A1 Feb. 19, 2009

Related U.S. Application Data

(60) Provisional application No. 60/901,993, filed on Feb. 16, 2007.

(51) Int. Cl.
*E04B 1/00* (2006.01)
*E04G 21/00* (2006.01)

(52) U.S. Cl. ..... 52/745.05; 52/414; 52/650.1; 52/653

(58) Field of Classification Search ..... 52/414, 52/650.1, 653.2, 745.05, 843
See application file for complete search history.

(56) References Cited

U.S. PATENT DOCUMENTS

| | | | | |
|---|---|---|---|---|
| 4,205,497 | A * | 6/1980 | Schirm | 52/93.2 |
| 4,918,897 | A * | 4/1990 | Luedtke | 52/742.14 |
| 5,657,606 | A * | 8/1997 | Ressel et al. | 52/690 |
| 5,906,080 | A * | 5/1999 | diGirolamo et al. | 52/243.1 |
| 6,460,297 | B1 * | 10/2002 | Bonds et al. | 52/79.1 |
| 7,028,439 | B2 * | 4/2006 | Foderberg et al. | 52/414 |
| 7,856,786 | B2 * | 12/2010 | Beck et al. | 52/650.1 |
| 7,882,665 | B2 * | 2/2011 | Kawai et al. | 52/236.6 |

* cited by examiner

*Primary Examiner* — William Gilbert
*Assistant Examiner* — Patrick Maestri
(74) *Attorney, Agent, or Firm* — J. Michael Neary

(57) ABSTRACT

A building frame resistant to earthquakes, gale-force wind loads, fire, insects and rot includes a peripheral frame wall constructed of square or rectangular steel tubing. Side wall frame modules bolted together along adjacent edges, and end wall modules bolted together along adjacent edges and to the ends of the connected side wall modules form the peripheral frame wall. Diagonal bracing is built into selected side and end wall modules as required for the desired degree of wind resistance. Trusses made of various size tube such as 2×3 inch rectangular steel tubing for supporting a roof on the peripheral wall, are assembled and welded in a welding shop and the prefabricated trusses and wall modules are trucked to the building site. Multiple stones may be erected and fastened together, and the building frame is secured to a foundation or slab by attaching to anchor bolts or plates.

18 Claims, 14 Drawing Sheets

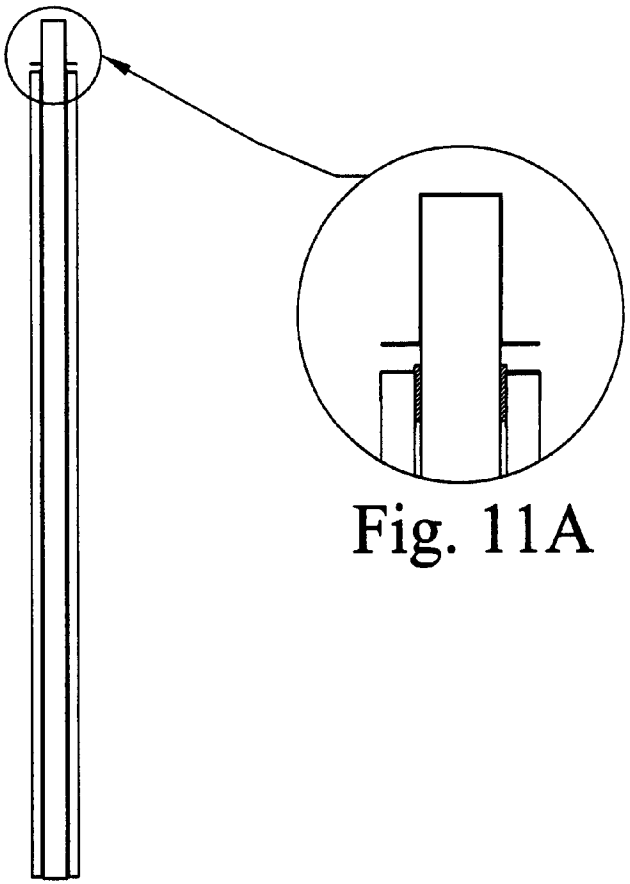
Fig. 11A
Fig. 11
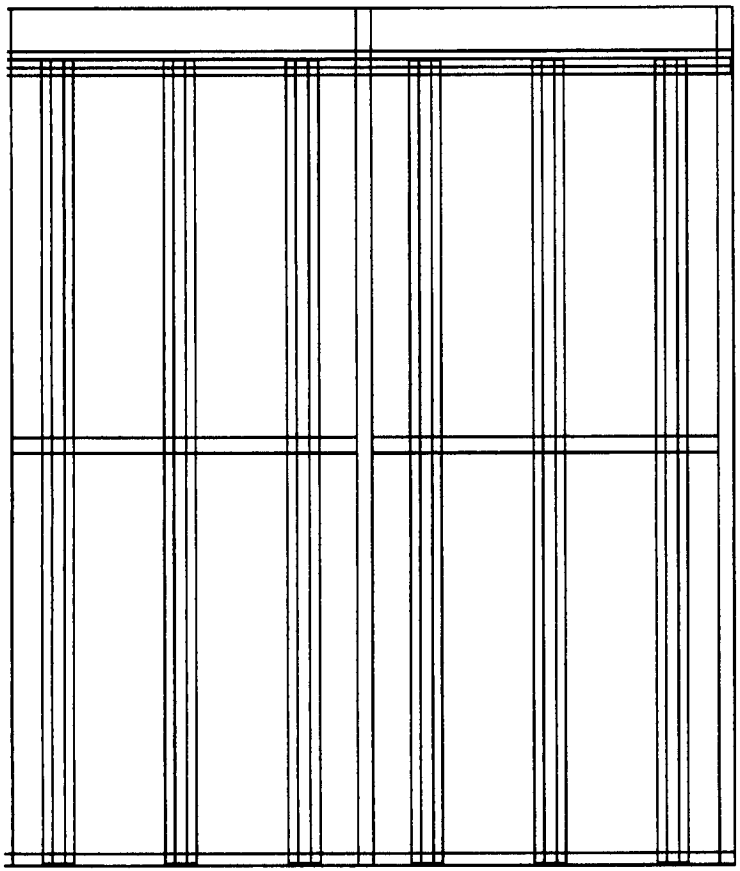
Fig. 10

INSULATED MODULAR BUILDING FRAME

This invention relates to improved building frames constructed from prefabricated frame modules, and buildings constructed from such frames, and more particularly to fire and insect resistant buildings that can be built with multiple stories, resistant to wind, impact and seismic damage and with interior and exterior walls that are isolated from the support frames to enhance thermal and acoustical values.

BACKGROUND OF THE INVENTION

Conventional building practice for residence housing and small commercial buildings has in the past relied primarily on wood frame construction in which the building frame is constructed on site from framing lumber cut to fit piece-by-piece individually. It is a labor-intensive process and demands considerable skill from the carpenters to produce a structure that has level floors, perfectly upright walls, square corners and plumb door and window openings. Even when the building frame is constructed with the requisite care and skill, it can become skewed by warping of the lumber, especially modern low grade lumber produced on tree farms with hybrid fast-growth trees.

Although conventional wood frame buildings require very little equipment for construction, they have become quite costly to build. The labor component of the cost is substantial, partly because of the wages that must be paid for the laborious process of constructing the frame, and partly because of the many government mandated extra costs such as workman's compensation and liability insurance, social security payments, medical insurance premiums, and the host of reports that must be made to the Government by employers. Accordingly, employers now seek to minimize their work force by whatever means is available to minimize these burdensome costs.

Steel frame construction, usually referred to as "red iron" construction, is commonly used on commercial buildings because of its greater strength, fire resistance and architectural design flexibility. The parts of such a steel frame are typically cut and drilled to order in accordance with the architect's plans, then trucked to the building site and assembled piece-by-piece with the use of a portable crane. The building can be made precisely and as strong as needed, but the cost is relatively high because of the costly materials and the skilled crew and expensive equipment need to assemble the building. It is a construction technique generally considered unsuitable for single family residence building because the cost is high and the building walls are substantially thicker than those made using standard frame construction, so standard door and window units do not fit properly and must be modified with special trim that rarely produces the desired aesthetic appearance.

Earthquake damage is becoming a matter of increasing concern among homeowners because of the publicity given to damage and loss of life in recent earthquakes in the U.S. and abroad. Earthquake preparedness stories and advice abound, but an underlying unresolved concern is that conventional wood frame homes in the past were not built to tolerate the effects of an earthquake, neither in its ultimate load-bearing capability nor its post-quake serviceability limits. Modern building codes attempt to address this concern, but the measures they require add to the already high cost of a new home and may not always provide significantly improved resistance to earthquake damage, particularly with respect to after-quake serviceability.

Fire often follows an earthquake, as happened in the disastrous Kobe earthquake of 1994, and of course fire is a major threat to homes independent of earthquake. When fire breaks out in a conventional home, the wood frame fuels the fire and reduces the chances of successfully extinguishing it before the entire structure is destroyed. The major life saving advance in the recent past is the fire alarm which detects the fire and alerts the occupants that a fire has started so they may escape before burning up with the house, but significant improvements to the fire resistance of the home itself that would retard the spread of the fire would be desirable.

The other major catastrophic threat to homes is wind. Wind loads on wood frame homes have destroyed many homes, primarily because the roof is usually attached so weakly to the walls that the combination of lift, exerted upward on the roof by the Bernoulli effect of the wind flowing over the roof, and pressure under the eves tending to lift the roof off the walls, wrenches the roof off the walls and allows the wind to carry the roof away like a big umbrella. Without the roof, the walls of the house collapse readily under the wind load, completing the total destruction of the house.

Termite and carpenter ant damage to wood frame homes is a major form of damage, costing many millions of dollars per year. Although the damage done by insects is rarely life threatening, it is actually more extensive in total than the combined effects of wind and earthquake, and it is an ever-present danger in many parts of the country.

These and other problems with wood-frame construction have made the insurance costs for new buildings, particularly for multi-story residential construction such as apartment and nursing home construction, increasingly expensive.

Thus, there has existed an increasing need for a home building frame design that would enable the inexpensive construction of homes that are highly tolerant of the effects of earthquakes, do not support combustion, are capable of withstanding high winds, are immune to damage from insects, and can use standard building components such as door and window units. Such a building frame concept would be even more commercially valuable if it were possible to erect the building in a short time with a small crew and without heavy equipment, and the frame could be adapted to produce buildings of attractive building styles desired locally. Such a building frame is disclosed in U.S. Pat. No. 6,003,280 issued to Orie Wells on Dec. 21, 1999, and in U.S. Pat. No. 6,460,297 issued to Delton J. Bonds on Oct. 8, 2002, both of which are assigned to the assignee of this application. However, numerous improvements were found to be desirable in the building frame system shown in those patents for improved design flexibility, fabrication economy, ease of assembly and improved structural strength and resistance to adverse environmental conditions. Multi-story construction with concrete floors flush with top of frame and linked together by rebar extending through holes in the interior wall frames or by joists attached to support the floor and to structurally link the opposed walls to provide in-plane shear transfer and diaphragm continuity in and through the entire wall frame, and frames stacked vertically and bolted together w/o crushing the frame members would improve the structural strength of the building frame, and frame modules insulated from interior furring channels would improve the sound and thermal insulation of the interior and external walls of the building. These and other improvements would make the building system disclosed in these two patents even more desirable.

SUMMARY OF THE INVENTION

Accordingly, these and other features of the invention are attained in an improved building frame, ideally suited for single story and low multi-story buildings, that can be assembled rapidly at the building site by bolting together a multiplicity of unitary metal frame modules that have been pre-fabricated off site. The frame for the building is made from a multiplicity of wall modules attached edge-to-edge to form a peripheral wall frame for the building frame. The wall modules are unitary rectangular frames made of square, round or rectangular structural steel tubing. Several different wall module designs can be used, including one having a top tube, two upright tubes, and a bottom tube, welded at four corners of the module and having internal braces for strengthening and stiffening. Light gauge furring channels are attached to each side of the wall frames, interior and exterior with screws. Isolator tape is positioned between the wall frame and the interior furring channels that are attached to the frame. The isolator tape minimizes thermal and acoustic metal-to-metal conduction across the wall frame and the interior furring by creating a separation between adjacent metal surfaces of approximately ⅛". Interior and exterior finishing materials are fastened directly over the interior and exterior furring. Insulation fills the space between the exterior siding and the interior furring channels.

Rim track can be attached to the wall frames, spaced below the top of the wall frame, to support floor joists. The rim track is a C-shaped channel with a top and bottom flange projecting outward of the peripheral building frame. The ends of the floor joists are fitted into the rim track between the top and bottom flanges and are attached to the rim track by right-angle brackets that are attached, by screws or welding, to the rim track and to the joist web. The attachment of the floor joists in this way provides in-plane shear transfer and diaphragm continuity in and through the entire wall frame. Metal decking is supported on the joists. Rebar may be inserted through holes in the top tubes of the peripheral wall frame to provide additional tensile coupling between opposite walls of the building. A concrete floor is poured on the metal deck flush with the top of the building frame, thereby allowing the top of the wall frames to be used as a screed when the concrete deck is being poured and leveled, and producing a floor that is flush with the top of the wall frame. The rebar links adjacent concrete floor panels and provides in-plane shear transfer and diaphragm continuity in and through the entire wall frame.

Some of the wall modules can be rectangular frames made of an upwardly opening bottom channel, a downwardly opening top channel, and large high load capacity upright rectangular structural steel tubing seated into the upwardly opening bottom channel and the downwardly opening top channel, and attached to the channels by welding or screw fasteners. The top channels can each include an inwardly extending flange that functions as a metal deck supporting ledger below the top surface of the channel for supporting a poured concrete floor, such that a concrete floor can be poured onto the metal decking to form a floor for a second or more story of said building.

DESCRIPTION OF THE DRAWINGS

The invention and its many attendant objects and advantages will become better understood upon reading the following description of the preferred embodiment in conjunction with the following drawings, wherein:

FIGS. 10 and 11 are front and side elevations of a frame module like that shown in FIG. 9, but with interior and exterior furring channels attached;

FIG. 11A is an enlarged section of the circled portion of FIG. 11;

FIG. 16 is an elevation of a wall module, before attachment of the furring channels, showing internal X-bracing attached to reinforcing corner gussets welded into the corners of the wall module; and.

DESCRIPTION OF THE PREFERRED EMBODIMENTS

Figure 1:
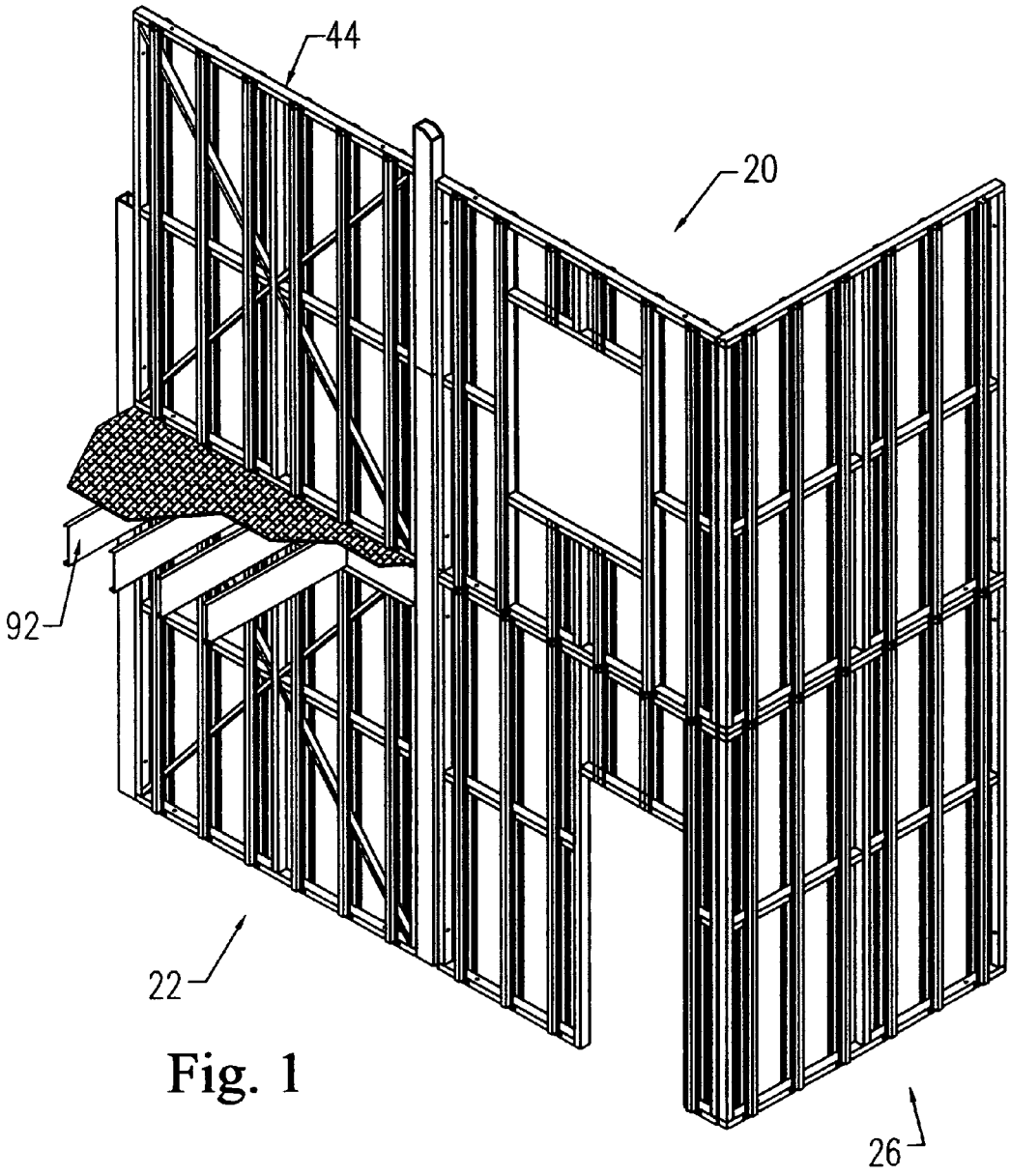
FIG. 1 is a perspective view of a corner at one end of a two-story building frame made in accordance with this invention.
Figure 2:
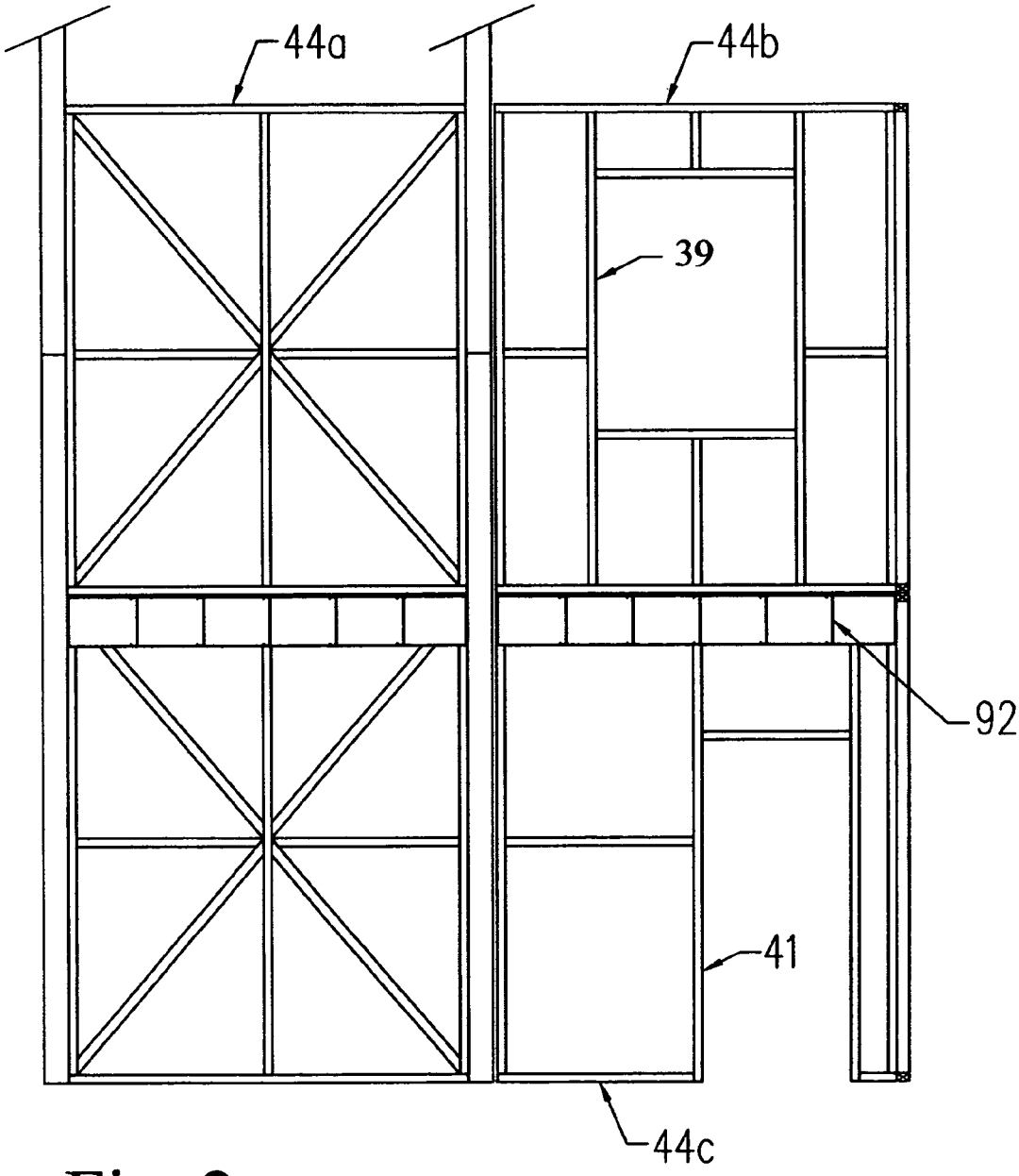
FIG. 2 is a cross sectional elevation view from the inside of the building frame shown in FIG. 1.

Turning now to the drawings, wherein like reference numerals designate identical or corresponding parts, and more particularly to FIGS. 1 and 2 thereof, one corner of a two-story building frame 20 is shown having a peripheral wall (shown only partially), the top edge of which would support a roof truss structure (not shown). The peripheral wall includes two end walls 22 (only one of which is shown in FIG. 1) connected at their ends to ends of two side walls 26 (a portion of only one of which is shown in FIG. 1).

Figure 3A:
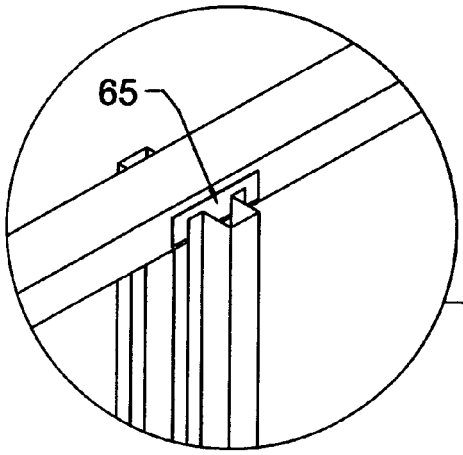
FIG. 3A is an enlarged view of a small portion of the building frame wall module shown in FIG. 3.
Figure 3:
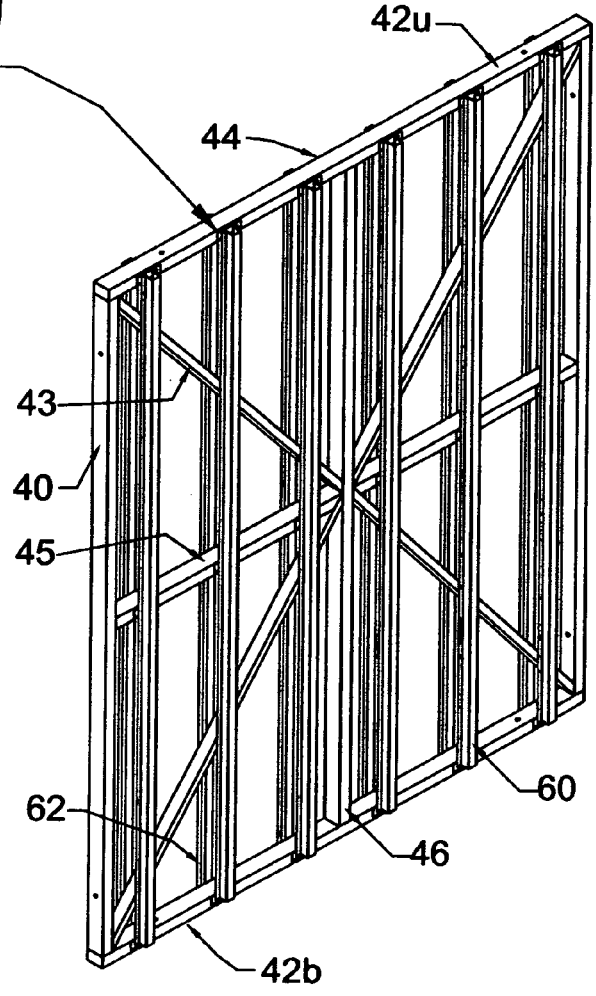
FIG. 3 is a perspective view of a top story building frame wall module for use in buildings made in accordance with this invention.

The end walls 22 and the side walls 26 are assembled from a plurality of wall modules 44, one type of which is shown in FIG. 3, which are fabricated off site and trucked to the building site where they are bolted or welded together as the building frame, shown in FIG. 1. The modules 44 can be made quickly and economically in a welding shop from lengths of rectangular, square, or round metal tubing, welded together at precisely 90° corners so that the assembled building frame is perfectly true and square when joined together. All sizes of tubing can be used, with the most common sizes that are commercially available, 2"×2" square steel tubing or 2"×3" rectangular steel tubing having wall thickness selected according to the height, geometry, and designed load capacity of the building. Yield strength of about 50 KSI and a tensile strength of about 55 KSI are typical, but seismic, wind, snow and drift forces govern the engineering requirements in all areas. Naturally, other materials could be used, but the materials noted above are most commonly specified because they are widely available from many sources at low cost and in various wall thicknesses and dimensions for different strength requirements in accordance with the building height, design and load carrying requirements. The gauge and dimensions of the steel tubing is selected based on the strength requirements of the building frame and will normally be within the range of 5-18 gauge.

Wall modules 44 may be made to a standard of exactly eight feet square, although the dimensions can conveniently be varied for different building designs if desired. The modules may be dimensioned to use standard interior wall board, such as that commonly sold in 4'×8' or 4'×12' panels, so the interior may be finished without extensive cutting of the wall board.

It will be noted that the modules 44 are typically not all identical. As shown in FIGS. 1 and 2, some modules 44*a* have interior X-bracing 43 to contribute shear stiffness to the assembled peripheral wall. Other modules 44*b* have window openings 39, and still other modules 44*c* have door openings 41. The ability to provide the different modules with different architectural features allows great architectural flexibility to the design of the building frame in accordance with this invention.

The modules are preferably welded together on a welding jig that holds the lengths of tubing at the desired 90° within about 2°, or preferably within about 1° tolerance. Care should be taken to tack weld the entire module before completely welding the junctions to avoid heat distortion of the assembly. GMAW (gas metal arc welding) welding has been found to produce clean welds that do not require de-slagging and also minimize heat input into the junction. If enough welding jigs are not available for the desired production rate, the first module may be made on the welding jig and the other identical modules may be made on top of the first as a pattern.

The wall module 44 on shown in FIG. 3 includes upper and bottom girt members 42*u* and 42*b*, two upright end members 40 welded to the ends of the girt members 42*u*&*b* and can include a center longitudinal girt member 45 welded between and spanning the end members 40. Internal diagonal brace members 43 are attached to the corners of the module 44 to provide diaphragm stiffness to the module.

Figure 16A:
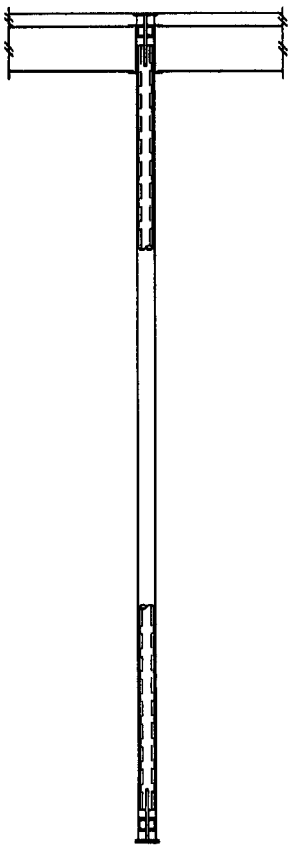
FIG. 16A is a sectional side elevation along lines 16A-16A in FIG. 16.
Figure 16:
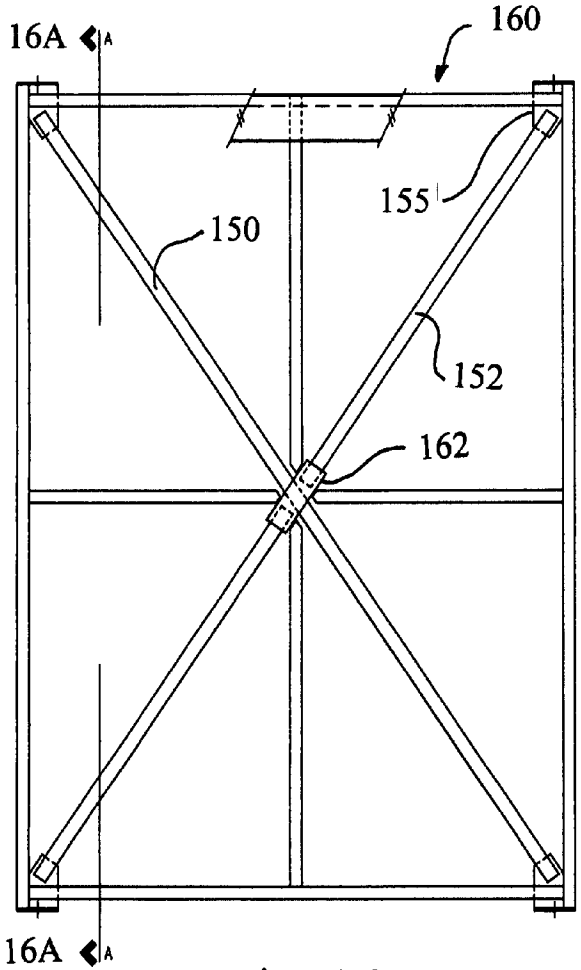

As shown in detail in FIG. 3, an internal X shear brace is provided, having 45° braces 43 welded to and between opposite corners of the module frame 44, or to corner gusset plates as shown in FIG. 16. The internal placement of the diagonal braces 43, within the module frame 44, defined by the two upright end members 40 and the upper and bottom girt members 42*u* and 42*b*, ensures that light gauge elements, to be described below, can be attached to the inside and outside faces of the frame module 44 without special cutting or other costly operations. A third upright member 46 may be welded to the upper and lower girt members 42*u* and 42*b* midway between the two upright end members 40 at the intersection of the diagonal braces 43 for additional vertical load bearing capacity if the building design requires the additional strength.

The X shear module 44 shown in FIG. 3 may be used in the peripheral wall 20 (FIG. 1) in all modules that do not have a window or door opening, to provide strength and stiffness in the plane of the wall section for resistance against deflection toward a parallelogram shape under wracking loads exerted by wind loads or lateral shaking during an earthquake. Because this invention can be used in buildings as high as ten stories, shear bracing is added for resistance to shear distortion as well as flexural distortion due to bending as a cantilever, so this strengthening minimizes not only threats to the safety of the occupants but also to the serviceability of the building after the windstorm or earthquake.

Typical door and window wall modules 44*b* and 44*c*, shown in FIGS. 1 and 2, do not normally include the diagonal shear bracing shown in the wall panel shown in FIG. 3 because the assembled wall frame with one or more X shear bracing modules 44*a* as shown in FIGS. 2 and 3 provides the shear stiffness for the entire wall.

Light gauge elements are welded or screwed to the frame modules 44 for attachment of exterior siding and interior finishing such as wallboard, paneling or the like. The light gauge elements shown in FIG. 3 include inside furring channels 60, and exterior furring channels 62. The inside channels 60 provide light gauge metal supports to which the interior wallboard can be attached by wallboard screws or the like. The interior sheet metal elements are typically about 22 gauge, on the order of 0.034". The exterior sheet metal elements are typically about 20 gauge, on the order of 0.040". These gauges provide the desired stiffness and ease of attaching to the tubing of the frame modules with self-drilling, self tapping fasteners while allowing ready penetration by drilling screws during attachment of the interior wallboard and exterior siding.

To provide for improved thermal and sound insulation between the building frame module and the interior wall board, isolator tape 65 is positioned between the frame modules and the interior furring channels that are attached to the frame, as shown in FIGS. 3A, and 4-7. The isolator tape 65 minimizes thermal and acoustic metal-to-metal conduction across the wall frame and the interior furring by creating a separation between adjacent metal surfaces of approximately ⅛"-¼". The isolator tape can be any material that provides thermal and acoustic insulation between the interior furring channels 60 and the frame modules 44. One material that has worked well is "Econobarrier" supplied by American Micro Industries. Another is Model 4504 supplied by 3M. These are typically 2"×4" rectangles of isolator tape about ⅜" thick attached by pressure sensitive adhesive to the module frame, over which the interior furring channels 60 are attached to the module frame.

Figure 4:
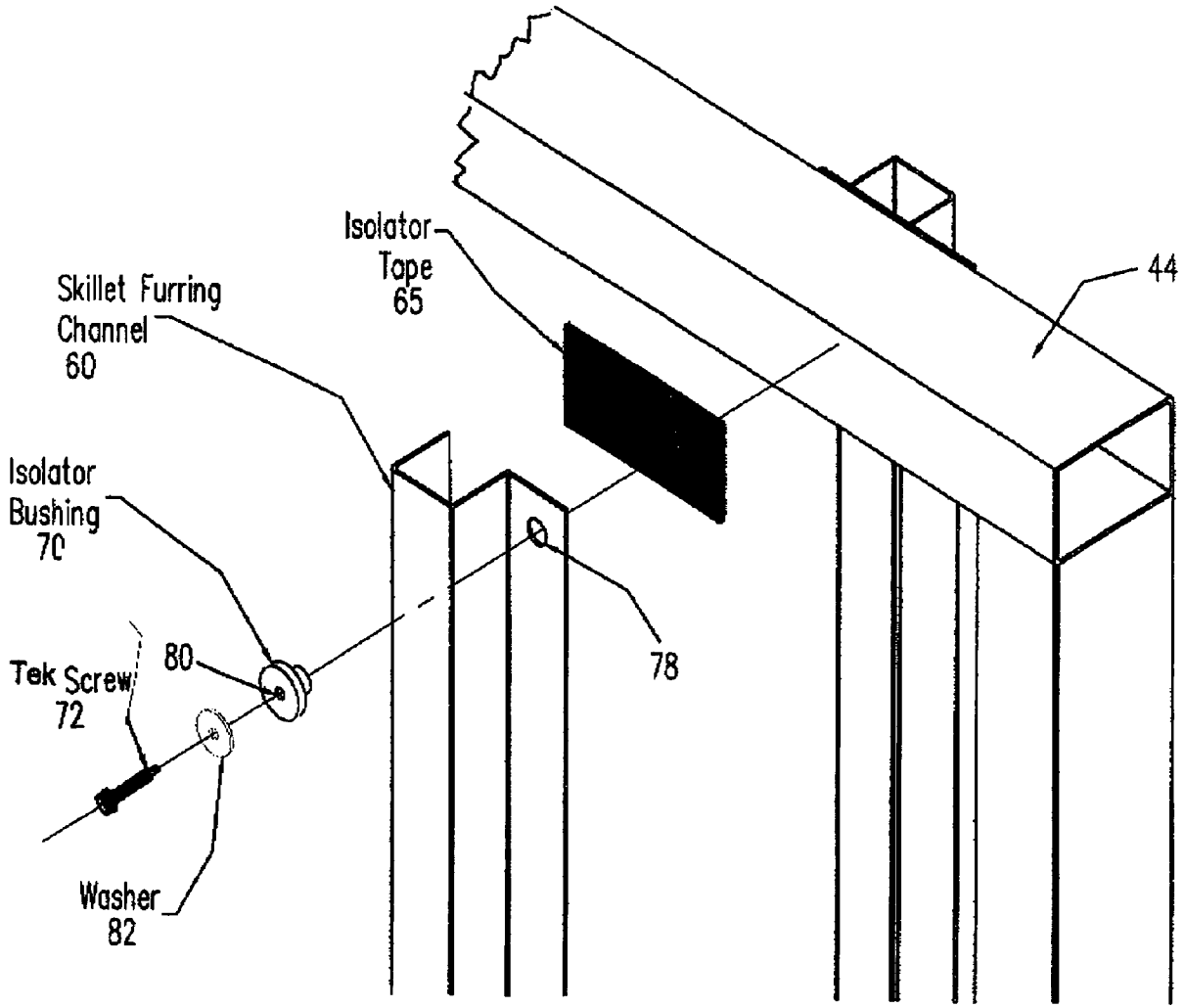
FIG. 4 is an exploded perspective view of a portion of a frame module with an isolator tape between the frame and an interior furring channel.
Figure 6A:
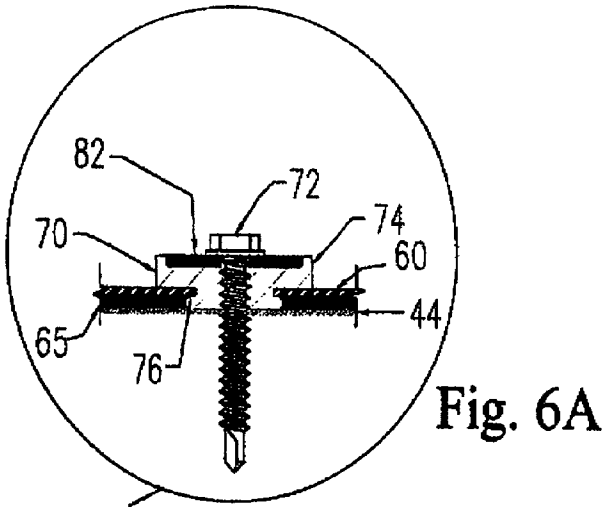
FIG. 6A is an enlarged sectional view of the circled area of FIG. 6, shown similar to FIG. 5, showing an isolator bushing in an interior furring channel, fastened to a frame over an isolator tape and illustrating the compression of the isolator bushing and its stand-off effect to prevent the crushing of the isolator tape.
Figure 6:
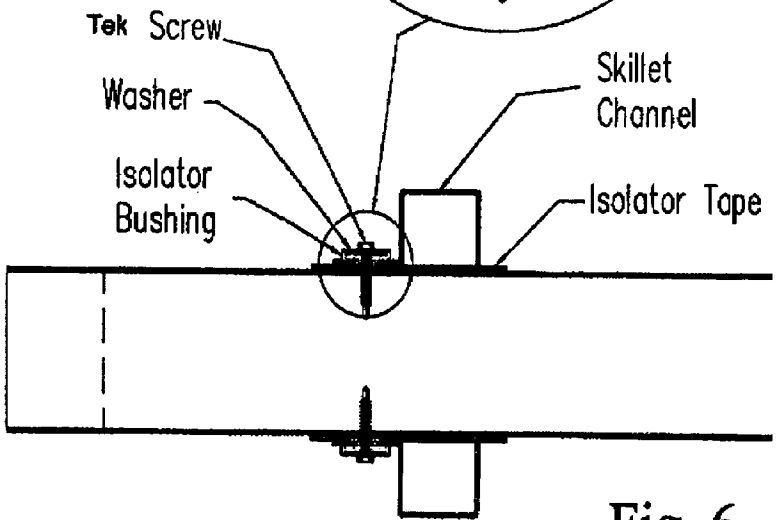
FIG. 6 is a sectional view of isolator bushings fastened to interior and exterior furring channels by screws which also fasten the channels to a frame over an isolator tape.

For optimal thermal and acoustic insulation, the isolator tape 65 is normally a foamed material. To prevent the isolator tape from being crushed between the module frame and the interior furring channels 60, which would reduce its insulating properties, an isolator bushing 70, shown in FIGS. 4-6A, can be utilized to provide a stand-off of the furring channel 60 from the module frame, and also to insulate the interior furring channels 60 from the screw 72 that holds the furring channels 60 to the module frame. The bushing, shown in FIGS. 4 and 5, is a hat-shaped item having a circular top flange 74 and a depending cylinder 76 made of damping thermoplastic material that will deform under load, but has sufficient stiffness to allow the screw 72 to hold the furring channel 60 firmly in place when the screw 72 is screwed into the module frame, as shown in FIGS. 6 and 6A.

Figure 5:
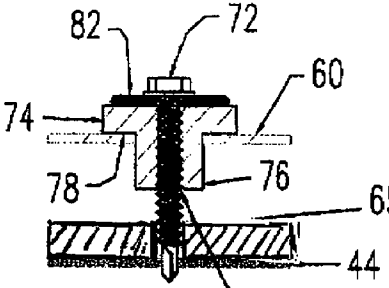
FIG. 5 is a sectional view of an isolator bushing and a fastening screw drilling into an interior furring channel fastened to a frame over and through an isolator tape.
Figure 7:
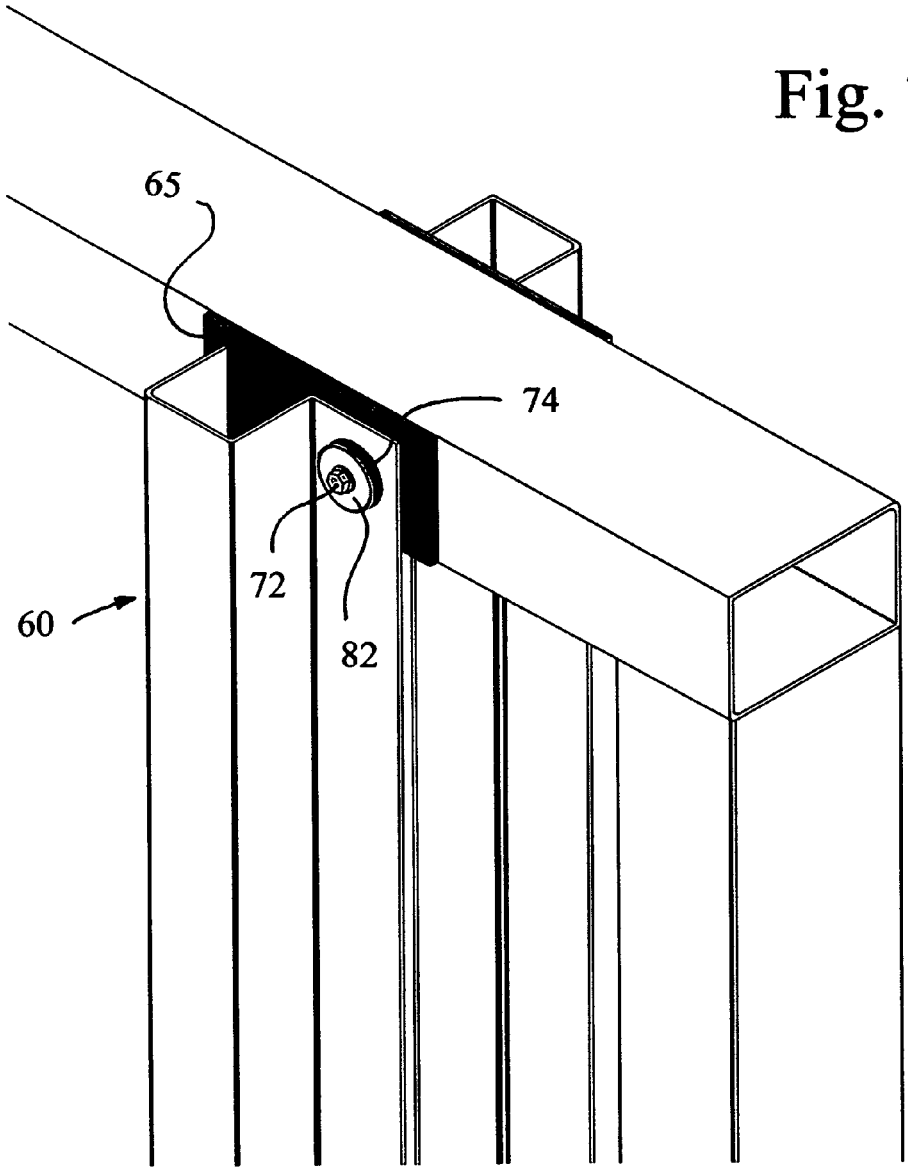
FIG. 7 is a perspective view of an interior furring channel attached to a wall frame module over an isolator tape with a Tek Screw, washer, and an isolator bushing.

As shown in FIG. 5, the depending cylinder 76 of the isolator bushing 70 fits through a hole 78 in the furring channel 60 and bears against the isolator tape 65. The screw 72 extends through a central hole 80 in the isolator bushing 70, and the screw head of the screw 72, bearing against a washer 82, compresses the isolator bushing against the module frame and distorts the depending cylinder 76 as shown in FIG. 6A to the extent that the furring channel 60 is held firmly at a stand-off position relative to the module frame such that the isolator tape is not compressed to the point that it loses its insulating value, and the furring channel 60 remains firmly held and spaced apart from the module frame by at least about ⅛".

The screw 72 is illustrated as a self-drilling, self-tapping screw, but other types of fasteners will also work where the particulars of the materials and labor economics so indicate. It should also be noted that the interior furring channel 60 illustrated in FIG. 6 is a "skillet" channel rather than a more conventional "hat" channel. That is, it has only one attachment flange rather than the more conventional symmetrical two-flange "hat" shape. The skillet channel is less costly, lighter, easier and faster to install and presents a smaller heat conduction pathway from the module frame to the wall board, but hat channels can be used if off-setting circumstances indicate.

Figure 12:
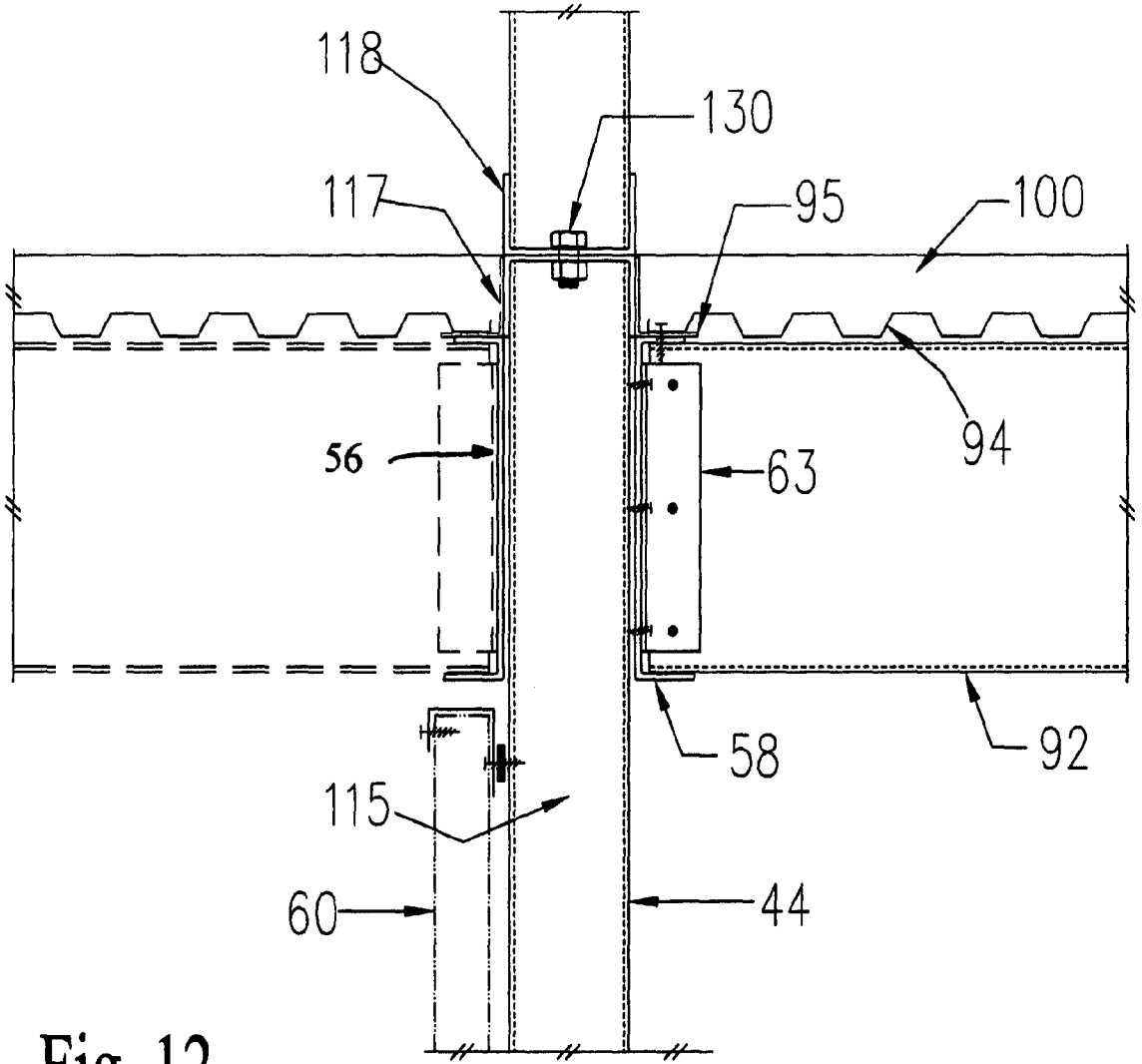
FIG. 12 is an elevation of a wall module assembly made with wall modules as shown in FIGS. 10 and 11, showing the vertical connection of two vertically adjacent modules.
Figure 13:
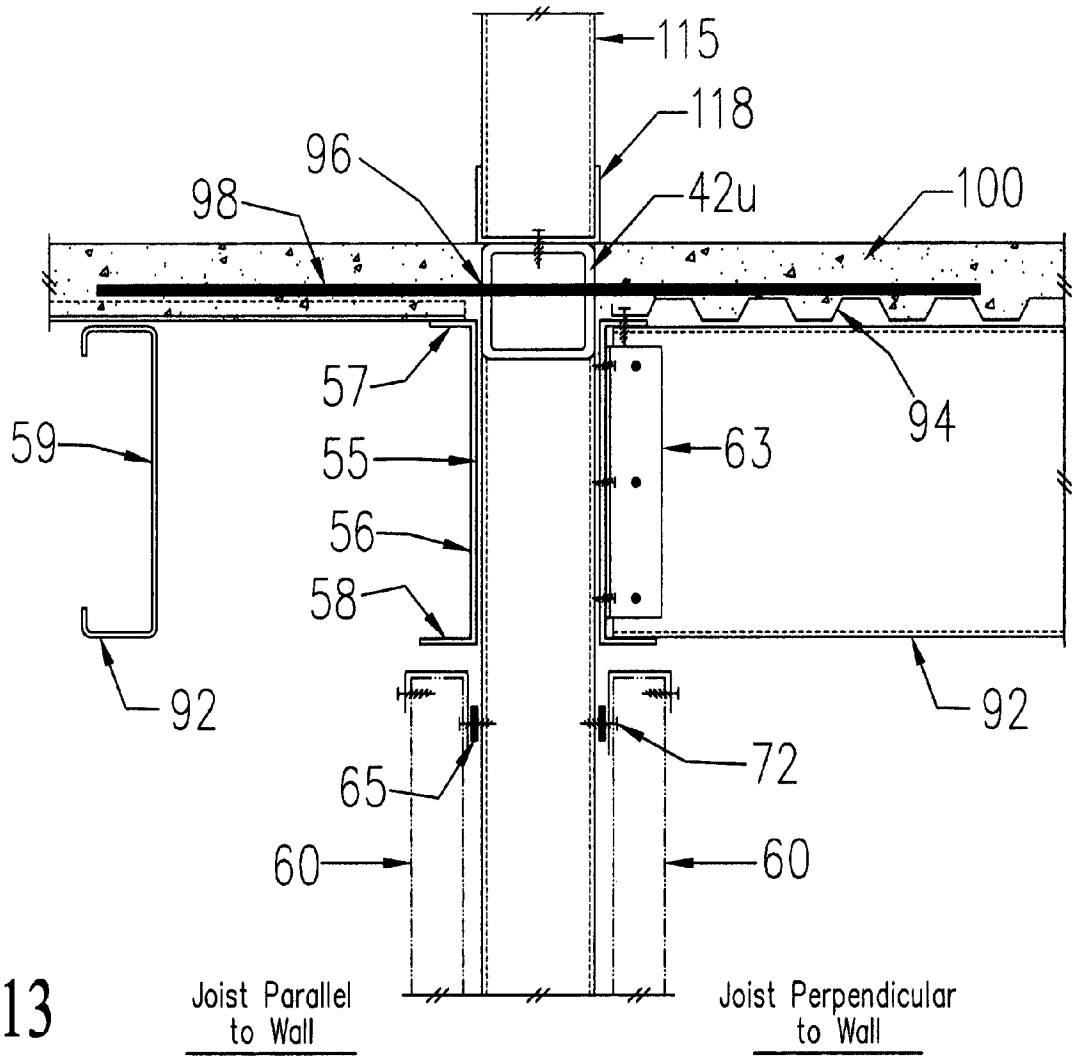
FIG. 13 is an elevation of a wall module assembly using a horizontal steel tube rather than a track assembly on the top plane of the module wall assembly.

The lower story wall modules 44 shown in FIGS. 1 and 2 use the same basic welded tubing design described above in conjunction with FIG. 3. When the building is to be built with more than one story, the height of the modules may be increased to accommodate second and higher story floor joists 92, shown in FIGS. 1 and 2, and also in FIGS. 8, 12 and 13. The floor joists 92 can be in the form of BCI joists, C-channel (as shown) or any other suitable form that is capable of supporting the floor load over the designed span. They are supported at their ends by a series of suitable joist hangers of known design (not shown), or by a rim track 56 that is welded to the wall module 44 as shown in FIGS. 12 and 13. The rim track 56 has upper and lower flanges 57, 58 projecting outward from a rim track web 55 toward the space spanned by the floor joists 92, and the ends of the floor joists 92 are supported on the lower flange 58. In addition, a series of joist attachment brackets 63 are attached to the rim track web 55 by screws or welding, and are attached to the ends of the floor joist web 59 by screws, as shown, or by welding. The hard attachment of the joists 92 between opposite walls of the building frame stiffens the frame against "oil can" diaphragm flexing of the side and end walls of the building frame and provides in-plane shear transfer and diaphragm continuity in and through the entire wall frame. Another floor joist support arrangement is to weld a bracket 90 to the module frame, as shown in FIG. 8, and to bolt the floor joists 92 to the bracket 90.

Figure 8:
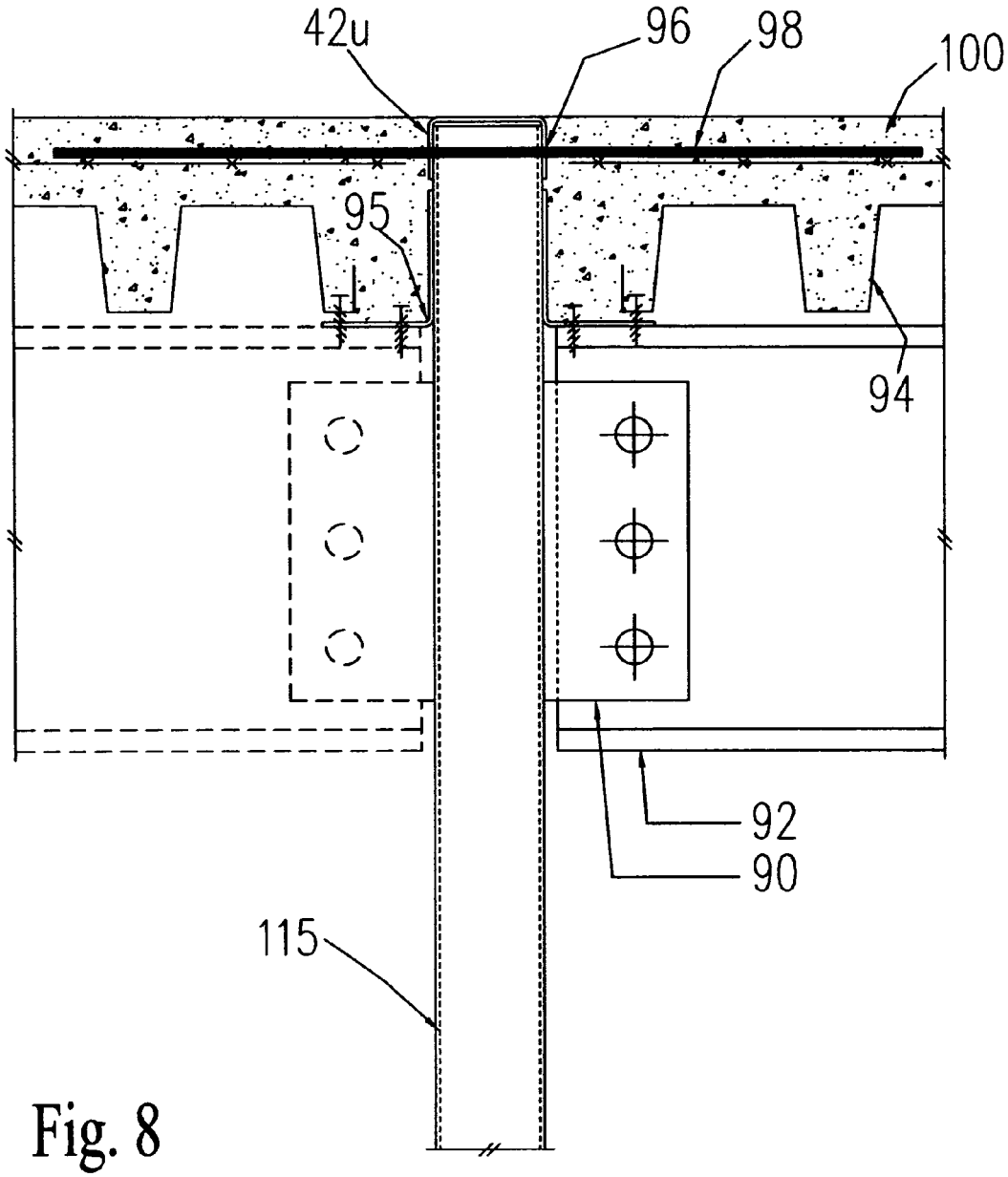
FIG. 8 is an elevation of a wall module supporting a pair of floor or roof joists to which are attached a metal deck on which a concrete floor or roof has been poured, and also showing rebar extending through a hole in the top of the frame for linking adjacent concrete floor panels and providing in-plane shear transfer and diaphragm continuity in and through the entire frame assembly.

If a concrete floor is to be used, a metal deck 94 can be laid on and supported by the joists 92 and attached to the top of the upper flange 57, as in FIG. 13, or to a supporting ledger 95 that is welded to the module frame uprights near the top, as shown in FIG. 8. As shown in FIG. 13, holes 96 can be drilled in the upper frame member 42*u* of the peripheral wall frame and rebar 98 inserted through the holes 96. A concrete floor 100 is poured onto the metal decking, and the tops of the upper members 42*u* are used as a screed to level the concrete. The rebar 98 links adjacent concrete floor panels on opposite sides of the upper frame member 42*u* and provides in-plane shear transfer and diaphragm continuity in and through the entire wall frame, such that the concrete floor is flush with the top of the wall frame and provides structural diaphragm linkage for the floor across the entire floor surface of the building.

Figure 9:
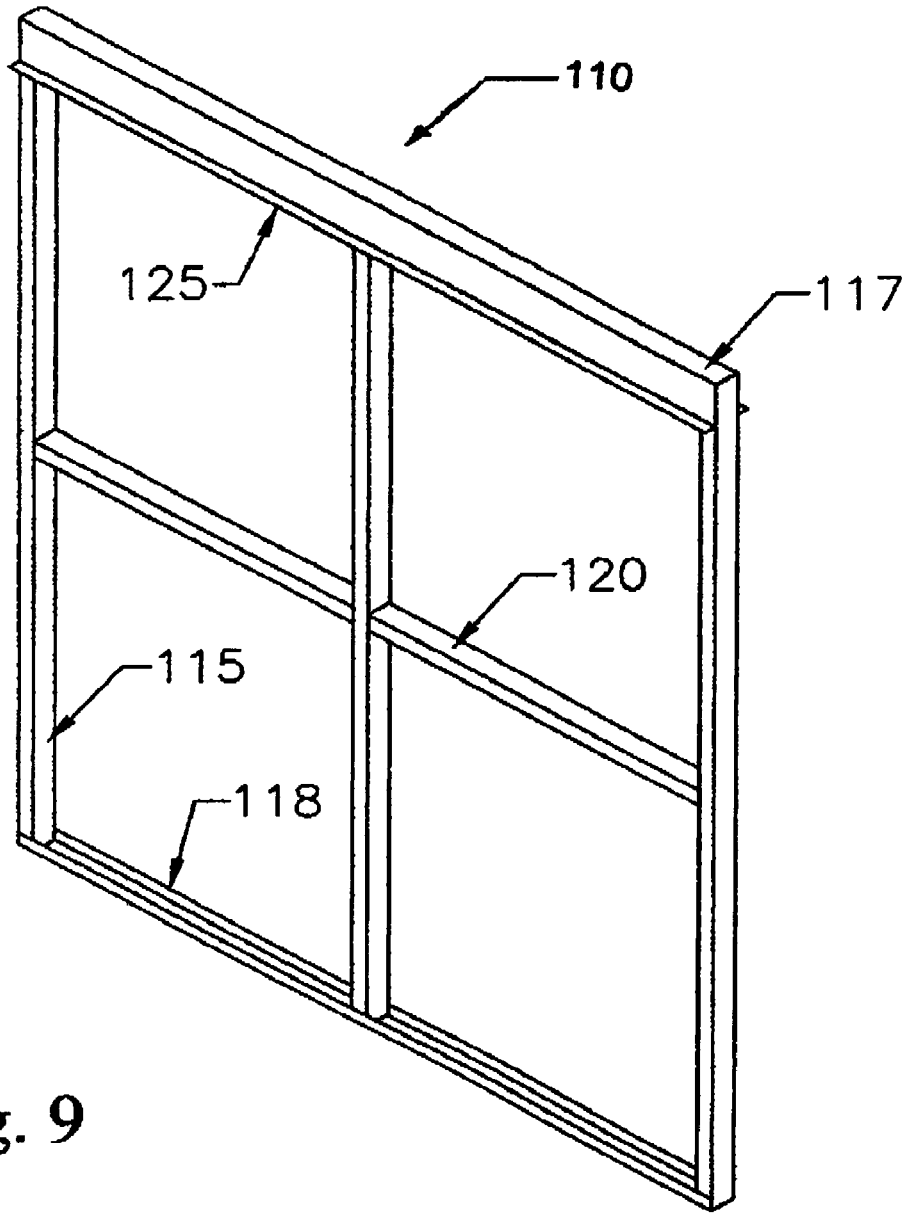
FIG. 9 is a perspective view of a wall frame module in accordance with this invention showing large rectangular vertical tubes fastened in a bottom channel and a top channel with integral flanges for supporting a metal deck.

Another type of frame module for building frame peripheral walls, and particularly for party and demising walls within and between the peripheral frame 22, 26, can be made with module frames 110 shown in FIGS. 9-12 in which the vertical members of the frame modules are large diameter square or rectangular tubes 115 set in and attached to top and bottom open channels 117 and 118. The number of vertical tubes in a frame module is determined by the load carrying and span capacity of the building design. As shown in FIG. 9, the number of vertical tubes can be as few as three, leaving large areas unencumbered for window and door openings and the like. A central horizontal tube 120 can be welded between the vertical tubes 115 for support against bowing under load.

As shown in FIG. 12, party and demising walls 22 can be made with wall modules which support an upper story floor directly on top of the modules of the next lower story. In the embodiment shown in FIG. 12, the upper story floor is made of a concrete slab 100 poured on a metal deck 94 supported atop joists 92 that are supported at their opposite ends in rim tracks 56 attached to the vertical tubes 115, and by right angle brackets 63 attached between the rim tracks 56 and the joist 92, as also shown in FIG. 13.

The top channel 117 can be provided with integral flanges 95 to which a metal deck 94 can be attached, as shown in FIG. 12. The metal deck 94 is supported by joists 92 attached to flanges 90 secured to the vertical tubes 115, similar to the structure shown in FIG. 8 Although not shown in FIG. 12, holes may be drilled horizontally through the top of the vertical tubes 115 and the top channel 117 to receive reinforcing rebar, as in FIG. 8 for the same purpose.

As also shown in FIG. 12, another advantage of the frame module design shown in FIG. 9 is the ability to attach the frame modules vertically together and fasten them with high tension fasteners, such as the bolt 130 shown in FIG. 12 without taking care to prevent crushing the top and bottom abutting tubes 42 u&b of the modules shown in FIGS. 1-3.

Figure 14A:
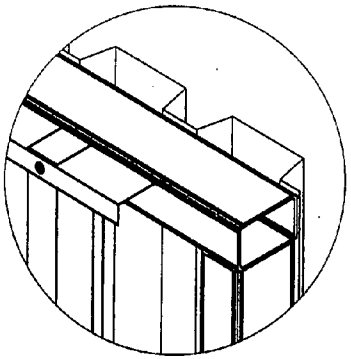
FIG. 14A is a detailed view of the area A in FIG. 14.
Figure 14B:
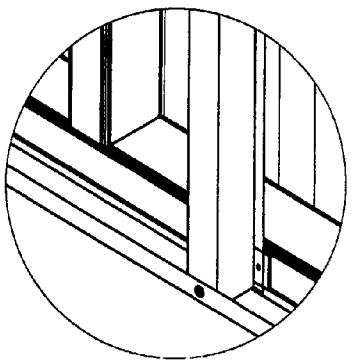
FIG. 14B is a detailed view of the area B in FIG. 14.
Figure 14:
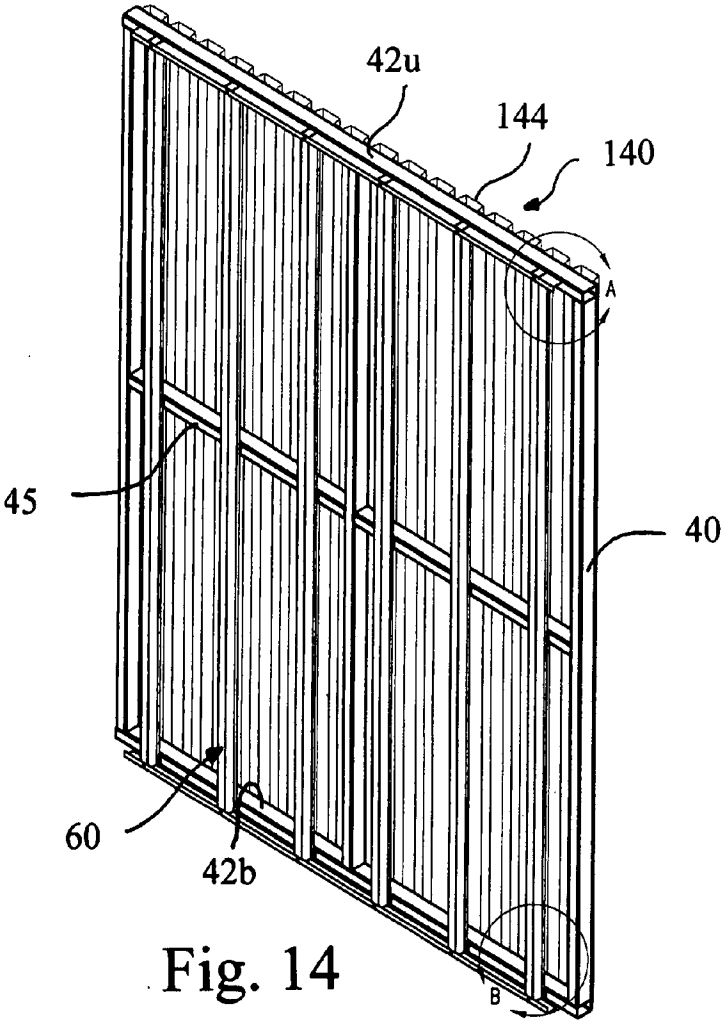
FIG. 14 is a perspective view of a wall module assembly, viewed from the inside, using metal decking in lieu of exterior furring for wind, impact and shear resistance.
Figure 15A:
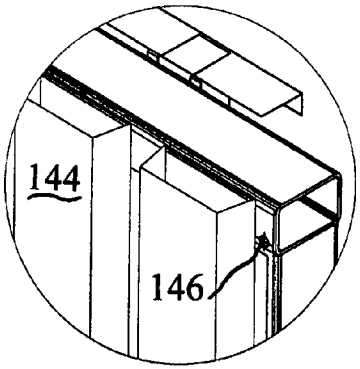
FIG. 15A is a detailed view of the area A in FIG. 15.
Figure 15B:
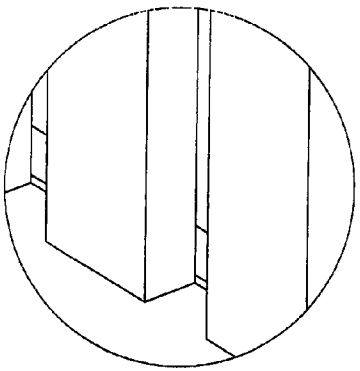
FIG. 15B is a detailed view of the area B in FIG. 15.
Figure 15:
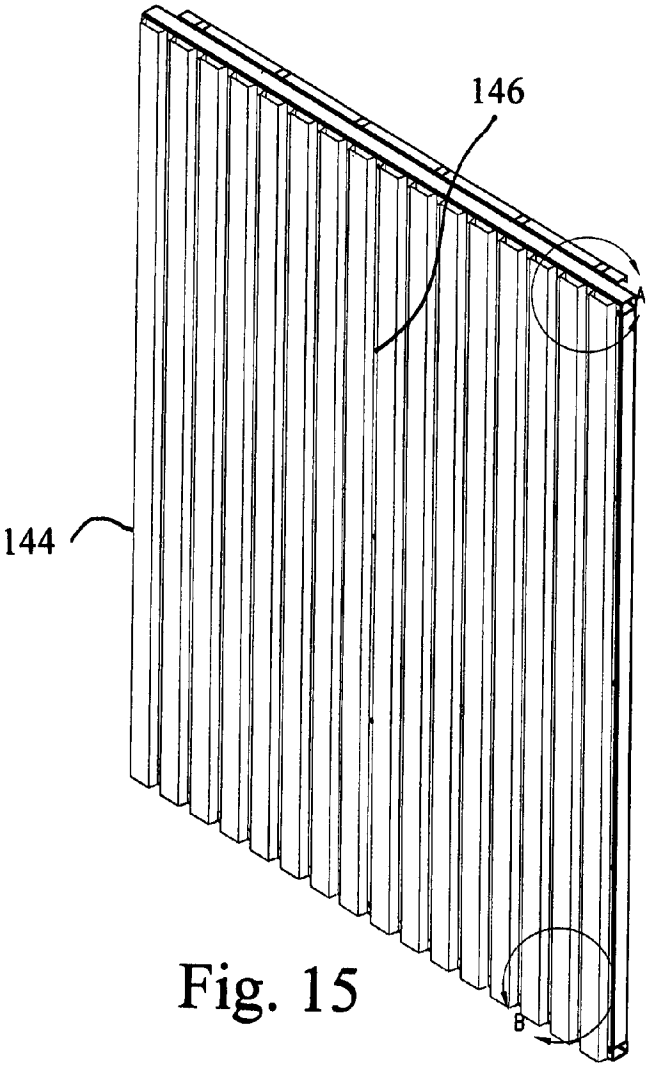
FIG. 15 is a perspective view of a wall module assembly like the module shown in FIG. 14, but viewed from the outside.

A building frame module 140, shown in FIGS. 14-15B, uses the same rectangular or square tubes shown in FIGS. 1-3. The module 140 has interior furring channels 60 fastened to the top and bottom module tubes 42 u&b, and to a center longitudinal girt member 45, if there is one. A corrugated steel panel 144 is attached directly to the exterior face of the module, typically by the use of self-drilling, self-tapping screws 146. The edges of the panel 144 can extend slightly beyond the upright end members 40 so they overlap on adjacent modules in the assembled building frame, and the junction of the steel panels 144 may be caulked to make the wall even more impermeable to wind-driven rain. A vapor barrier and exterior siding can be applied directly to the exterior surface of the panel for whatever finished appearance is desired.

The steel panel 144 provides ballistic protection against penetration by wind driven objects, which is a serious problem in regions afflicted by the possibility of tornados, hurricanes and other destructive meteorological events. The panel 144 also increases the resistance to wind-driven rain penetration, thereby greatly reducing the chances of mold and mildew damage. The panel 144 provides greatly increased shear strength to the module and to the entire building frame wall, and can eliminate the need for the X-bracing 43 shown in FIGS. 1-3, although such X-bracing may be used if the additional shear strength is needed.

The X-bracing shown in FIGS. 16 and 16A uses bracing tubes 150 and 152 that are slit at their ends and slip over gusset plates 155 welded into the corners of the module 160. The gusset plates strengthen the corners of the module and the slit ends of the tubes can be welded to the gusset plates to provide a large length of weldment and a very strong connection. It is also a much easier weld to make. One of the diagonal tubes 150 extend completely corner-to-corner, and the other diagonal tube is in two parts, with straps 162 welded between the end of the two parts to complete the connection. This structure is very quick and easy to manufacture and provides high shear strength to the panel. It also provides a know failure mode, buckling of the diagonal bracing rather than failure of the module uprights, girt members, or corners, so the building remains serviceable even after failure and the design can be specified with a high degree of certainty.

The invention thus enables the low cost construction of a building with capabilities of meeting multiple design requirements without major redesign. In areas where heavy snow loads can be expected, the pitch angle of the trusses can be increased to any desired angle to increase the load bearing strength and the snow shedding capability of the roof. In earthquake prone areas, the diagonal shear panels give redundant load sharing capability. The roofing material may be selected for minimum weight to minimize the inertial forces so the house moves more like a rigid unit rather than a flexible vertical cantilever. This will minimize the damage to the building caused by differential movement of the foundation and the roof so that the building will remain serviceable after the earthquake. The metal frame building is inherently immune to attacks by termites and carpenter ants as well as mold and mildew, and is inherently resistant to fire damage.

Obviously, numerous modifications and variations of the preferred embodiment described above are possible and will become apparent to those skilled in the art in light of this specification. Many functions and advantages are described for the preferred embodiment, but in some uses of the invention, not all of these functions and advantages would be needed. Therefore, I contemplate the use of the invention using fewer than the complete set of noted functions and advantages. Moreover, several species and embodiments of the invention are disclosed herein, but not all are specifically claimed, although all are covered by generic claims. Nevertheless, it is my intention that each and every one of these species and embodiments, and the equivalents thereof, be encompassed and protected within the scope of the following claims, and no dedication to the public is intended by virtue of the lack of claims specific to any individual species. Accordingly, I expressly intend that all these embodiments, species, modifications and variations, and the equivalents thereof, are to be considered within the spirit and scope of the invention as defined in the following claims, Wherein I claim:

1. A building system method, comprising:

prefabricating frame modules of rectangular structural steel tubing having a top tube, two upright side tubes and a bottom tube welded together at module corners off site, and trucking said modules to a building site;

supporting vertical loads with straight vertical support members in some of said frame modules having straight vertical support members only, free of diagonal brace members, allowing architectural freedom in the placement of window and door openings unrestricted by diagonal braces, and by larger dimension vertical support members interposed between some horizontally adjacent sets of vertically stacked frame modules;

resisting lateral forces from wind and seismic events through diagonal brace members that are incorporated in other frame modules;

attaching all of said frame modules together, edge-to-edge to form a peripheral building frame wall and at least one interior frame wall;

attaching rim tracks to said wall frames spaced below the top of said wall frame and having upper and lower flanges projecting outward of said wall frames;

supporting floor joists at ends thereof in said rim tracks for supporting floor decking; and pouring concrete onto said floor decking and leveling the top of said concrete flush with top surfaces of said frame top tubes.

2. A building system method as defined in claim 1, further comprising:

attaching said frame modules during erection with two bolts along all sides of said frame modules and, where required to resist lateral forces, providing additional bolts or welding at frame intersections.

3. A building system method as defined in claim 1, further comprising:

positioning isolator tape between said wall frame and said interior furring channels that are attached to said frame, said isolator tape minimizing thermal and acoustic metal-to-metal conduction across said wall frame and said interior furring by creating a separation between adjacent metal surfaces of approximately ⅛"-¼".

4. A building system method as defined in claim 3, further comprising:

corrugated metal decking attached to exterior surfaces of said wall modules for enhanced shear transfer and resistance to extreme wind conditions or high impact forces.

5. A metal frame building, comprising:

a plurality of wall modules attached edge-to-edge to form a peripheral wall frame for supporting a peripheral wall, and at least one interior wall frame for supporting an interior wall for said building;

said wall modules are rectangular frames made of rectangular, square or round structural steel tubing, each wall module having a top member, two upright tubes, and a bottom member, said tubes and members being fastened at four corners of said module for providing vertical support to said peripheral and interior walls;

rim tracks attached to said wall frames spaced below the top of said wall frames and having upper and lower flanges projecting outward of said wall frames;

floor joists supported at ends thereof in said rim tracks;

metal decking supported on said upper rim track flange or ledger and said floor joists;

a concrete floor poured onto said metal decking, the top of said concrete floor screed level with the top of said top members; and rebar extending through holes in said top members of said interior wall frame to link adjacent concrete floor panels and provide in-plane shear transfer and diaphragm continuity in and through the entire wall frame.

6. A metal frame building, comprising:

a plurality of wall modules attached edge-to-edge to form a peripheral wall frame for said building, said wall frame having an interior side facing inward of said building, and an exterior side facing outward of said building;

said wall modules include rectangular frames having a top member, two upright tubes, and a bottom member, said tubes and members attached together at four corners of said module and having internal braces for strengthening and stiffening;

said wall frames include light gauge furring channels for attaching interior finishing materials to interior faces of said wall frame, said furring channels attached to said modules by attachment screws extending from interior sides of said furring channels, through holes in said furring channels, and threaded into interior faces of said wall frame;

isolator tape positioned between said wall frame and said interior furring channels that are attached to said frame, said isolator tape minimizing thermal and acoustic metal-to-metal conduction across said wall frame and said interior furring by creating a separation between adjacent metal surfaces of approximately ⅛"-¼" after slight compression by said attachment screws;

interior finishing materials fastened directly over said interior furring.

7. A metal frame building as defined in claim 6, further comprising:

rim track fastened to said frames spaced below the top of said frames and above said interior furring channels for supporting ends of floor joists spanning the space between opposite walls for supporting a floor.

8. A metal frame building as defined in claim 6, further comprising:

isolator bushings on said attachment screws having an inner portion lying between said channels and said wall frame, said inner portion made of a material with sufficient stiffness to provide a stand-off that prevents said isolator tape from being crushed between said furring channels and said wall frame by force exerted by said attachment screws, while allowing adequate tension in said screws to hold said furring channels in place and preventing contact between said attachment screws and said furring channels.

9. A metal frame building as defined in claim 8, wherein:

said inner portion of said isolator bushings each includes a stand-off body, and said isolator bushings all also include a flange on one end of said stand-off body;

said flange lies on an exterior surface of said furring channel and said screw has a head that bears against said flange and exerts a compressive force against said flange to hold said furring channel in place against said isolator tape;

said stand-off body extends through an opening in said furring channel and prevents said compressive force of said screw head on said flange from crushing said isolator tape between said furring channel and said wall frame.

10. A metal frame building as defined in claim 9, wherein:

said isolator bushing is made of a thermally and acoustically insulating polymer having a hardness sufficient to resist the compressive forces exerted by said screws without such deformation as would crush said isolator tape to the extent that it would decrease the insulation afforded by said isolator tape when said screws are tightened sufficiently to hold said furring channels firmly to said wall frames.

11. A metal frame building as defined in claim 10, further comprising:

corrugated metal decking attached to exterior surfaces of said wall modules for enhanced shear transfer and resistance to extreme wind conditions or high impact forces.

12. A metal frame building as defined in claim 6, further comprising:

corrugated metal decking attached directly to the exterior face of said frame, free of exterior furring channels, for enhanced shear transfer and resistance to extreme wind conditions or high impact forces acting against the exterior of said building frame.

13. A metal frame building, comprising:

a plurality of wall modules attached edge-to-edge to form at least one interior wall frame and a peripheral wall frame for said building;

said wall modules for said interior wall frame are rectangular frames made of an upwardly opening bottom channel, a downwardly opening top channel, and large high load capacity upright rectangular structural steel tubing, said upright tubes seated into said upwardly opening bottom channel and said downwardly opening top channel seated and attached to said upright tubes by welding or screw fasteners;

said top channels each include an outwardly extending flange that functions as a ledger for supporting metal decking below the top surface of the channel for supporting a poured concrete floor, such that a concrete floor is poured onto said metal decking to form a floor for a second story of said building, said floor having a top surface flush with the top surface of said top channel;

attachment structure fastened to said interior wall modules beneath said outwardly extending flanges of said top channels for supporting floor joists spaced below the top of said wall modules.

14. A metal frame building as defined in claim 13, further comprising:

high tension fasteners connecting vertically adjacent panels together without crushing tubes that otherwise would form the top and bottom members of the wall panels.

15. A metal frame building as defined in claim 13, further comprising:

diagonal braces welded to gusset plates that are welded into corners of said module.

16. A metal frame building, comprising:

a plurality of wall modules attached edge-to-edge to form interior and peripheral wall frames for said building;

said wall modules include a plurality of rectangular frames made, in part, of rectangular structural steel tubing, each said rectangular frame having a top member, an upright tube at each end of said module, and a bottom member, said tubes and said members being connected at four corners of said frame and having internal braces for strengthening and stiffening;

ledgers attached to said wall frames spaced below the top of the wall frame and projecting outward of said peripheral building frame;

metal decking supported on said ledgers and rebar extending through holes in said top tubes of said interior wall frame to link adjacent concrete floor panels and provide in-plane shear transfer and diaphragm continuity in and through the entire wall frame, such that a concrete floor is poured flush with the top of said building frame, thereby allowing the top of the wall frames to be used as a screed when the concrete deck is being poured and leveled, and produces a top surface of said floor that is flush with the top of the wall frame.

17. A building system method as defined in claim 1, further comprising:

placing rebar through holes in said top members of said interior wall frame extending over said floor decking on both sides of said interior wall frame to link adjacent concrete floor panels and provide in-plane shear transfer and diaphragm continuity in and through the entire peripheral wall frame.

18. A building system as defined in claim 6, further comprising:

rim tracks attached to said wall frames spaced below the top of said wall frames and having upper and lower flanges projecting outward of said wall frames for supporting ends of floor joists spanning space between opposite walls;

metal decking lying on said floor joists for supporting a concrete floor poured onto said metal decking and having an upper surface screed level with the top of said top members.

* * * * *